US007420577B2

(12) United States Patent
Brown Elliott

(10) Patent No.: US 7,420,577 B2
(45) **Date of Patent: *Sep. 2, 2008**

(54) SYSTEM AND METHOD FOR COMPENSATING FOR VISUAL EFFECTS UPON PANELS HAVING FIXED PATTERN NOISE WITH REDUCED QUANTIZATION ERROR

(75) Inventor: Candice Hellen Brown Elliott, Santa Rosa, CA (US)

(73) Assignee: Samsung Electronics Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/739,065

(22) Filed: Apr. 23, 2007

(65) Prior Publication Data

US 2007/0188527 A1 Aug. 16, 2007

Related U.S. Application Data

(62) Division of application No. 10/455,927, filed on Jun. 6, 2003, now Pat. No. 7,209,105.

(51) Int. Cl.
*G09G 5/02* (2006.01)

(52) U.S. Cl. ..... 345/694; 345/602

(58) Field of Classification Search ..... 345/87–89, 345/694–696, 596, 598, 601, 602
See application file for complete search history.

(56) References Cited

U.S. PATENT DOCUMENTS 3,971,065 A 7/1976 Bayer
4,353,062 A 10/1982 Lorteije et al.
4,642,619 A 2/1987 Togashi
4,651,148 A 3/1987 Takeda et al.
4,773,737 A 9/1988 Yokono et al.
4,781,438 A 11/1988 Noguchi
4,800,375 A 1/1989 Silverstein et al.

(Continued)

FOREIGN PATENT DOCUMENTS

DE 299 09 537 U1 10/1999

(Continued)

OTHER PUBLICATIONS

Brown Elliott, C., "Active Matrix Display . . . ", IDMC 2000, 185-189, Aug. 2000.

(Continued)

*Primary Examiner*—Ricardo L. Osorio

(57) ABSTRACT

A display system comprises a display panel having a plurality of subpixels, a first look-up table (LUT) configured to provide gamma adjustment signals to input image data, an image processor configured to receive the gamma adjusted input image data for processing, a demultiplexer configured to receive and demultiplex the processed image data from the image processor, and second and third LUTs configured to receive the demultiplexed image data from the demultiplexer. The second and third LUTs correct fixed noise patterns in the demultiplexed image data. The system further comprises a multiplexer configured to receive and multiplex image data from the second and third LUTs, a driver configured to receive the multiplexed image data from the multiplexer and provide driving image data, and fourth and fifth LUTs receive the driving image data from the driver. The fourth and fifth LUTs adjust the driving image data for display on the panel.

13 Claims, 8 Drawing Sheets

U.S. PATENT DOCUMENTS

| | | | | |
|---|---|---|---|---|
| 4,853,592 | A | | 8/1989 | Strathman |
| 4,874,986 | A | | 10/1989 | Menn et al. |
| 4,886,343 | A | | 12/1989 | Johnson |
| 4,908,609 | A | | 3/1990 | Stroomer |
| 4,920,409 | A | | 4/1990 | Yamagishi |
| 4,965,565 | A | | 10/1990 | Noguchi |
| 5,006,840 | A | | 4/1991 | Hamada et al. |
| 5,052,785 | A | | 10/1991 | Takimoto et al. |
| 5,097,297 | A | | 3/1992 | Nakazawa |
| 5,113,274 | A | | 5/1992 | Takahashi et al. |
| 5,144,288 | A | | 9/1992 | Hamada et al. |
| 5,184,114 | A | | 2/1993 | Brown |
| 5,191,451 | A | | 3/1993 | Katayama et al. |
| 5,196,924 | A | | 3/1993 | Lumelsky et al. |
| 5,311,205 | A | | 5/1994 | Hamada et al. |
| 5,311,337 | A | | 5/1994 | McCartney, Jr. |
| 5,315,418 | A | | 5/1994 | Sprague et al. |
| 5,334,996 | A | | 8/1994 | Tanigaki et al. |
| 5,341,153 | A | | 8/1994 | Benzschawel et al. |
| 5,384,266 | A | | 1/1995 | Chapman |
| 5,398,066 | A | | 3/1995 | Martinez-Uriegas et al. |
| 5,436,747 | A | | 7/1995 | Suzuki |
| 5,438,649 | A | | 8/1995 | Ruetz |
| 5,448,652 | A | | 9/1995 | Vaidyanathan et al. |
| 5,450,216 | A | | 9/1995 | Kasson |
| 5,459,595 | A | | 10/1995 | Ishiguro |
| 5,461,503 | A | | 10/1995 | Deffontaines et al. |
| 5,485,293 | A | | 1/1996 | Robinder |
| 5,535,028 | A | | 7/1996 | Bae et al. |
| 5,555,359 | A | * | 9/1996 | Choi et al. ..... 345/441 |
| 5,563,621 | A | | 10/1996 | Silsby |
| 5,579,027 | A | | 11/1996 | Sakurai et al. |
| 5,646,702 | A | | 7/1997 | Akinwande et al. |
| 5,648,793 | A | | 7/1997 | Chen |
| 5,739,802 | A | | 4/1998 | Mosier |
| 5,754,163 | A | | 5/1998 | Kwon |
| 5,754,226 | A | | 5/1998 | Yamada et al. |
| 5,767,829 | A | | 6/1998 | Verhulst |
| 5,808,594 | A | | 9/1998 | Tsubyama et al. |
| 5,818,405 | A | * | 10/1998 | Eglit et al. ..... 345/88 |
| 5,818,968 | A | | 10/1998 | Yoshimoto |
| 5,877,512 | A | | 3/1999 | Kim |
| 5,899,550 | A | | 5/1999 | Masaki |
| 5,949,396 | A | | 9/1999 | Lee |
| 5,949,496 | A | | 9/1999 | Kim |
| 5,971,546 | A | | 10/1999 | Park |
| 6,005,692 | A | | 12/1999 | Stahl |
| 6,008,868 | A | | 12/1999 | Silverbrook |
| 6,037,719 | A | | 3/2000 | Yap et al. |
| 6,064,363 | A | | 5/2000 | Kwon |
| 6,069,670 | A | | 5/2000 | Borer |
| 6,088,050 | A | | 7/2000 | Ng |
| 6,097,367 | A | | 8/2000 | Kuriwaki et al. |
| 6,100,872 | A | | 8/2000 | Aratani et al. |
| 6,108,122 | A | | 8/2000 | Ulrich et al. |
| 6,115,092 | A | | 9/2000 | Greene et al. |
| 6,144,352 | A | | 11/2000 | Matsuda et al. |
| 6,147,664 | A | | 11/2000 | Hansen |
| 6,151,001 | A | | 11/2000 | Anderson et al. |
| 6,160,535 | A | | 12/2000 | Park |
| 6,188,385 | B1 | | 2/2001 | Hill et al. |
| 6,219,019 | B1 | | 4/2001 | Hasegawa |
| 6,219,025 | B1 | | 4/2001 | Hill et al. |
| 6,225,967 | B1 | | 5/2001 | Hebiguchi |
| 6,225,973 | B1 | | 5/2001 | Hill et al. |
| 6,236,390 | B1 | | 5/2001 | Hitchcock |
| 6,239,783 | B1 | | 5/2001 | Hill et al. |
| 6,243,055 | B1 | | 6/2001 | Fergason |
| 6,243,070 | B1 | | 6/2001 | Hill et al. |
| 6,278,434 | B1 | | 8/2001 | Hill et al. |
| 6,326,981 | B1 | | 12/2001 | Mori et al. |
| 6,327,008 | B1 | | 12/2001 | Fujiyoshi |
| 6,332,030 | B1 | | 12/2001 | Manjunath et al. |
| 6,335,719 | B1 | | 1/2002 | An et al. |
| 6,342,876 | B1 | | 1/2002 | Kim |
| 6,348,929 | B1 | | 2/2002 | Acharya et al. |
| 6,377,262 | B1 | | 4/2002 | Hitchcock et al. |
| 6,388,644 | B1 | | 5/2002 | De Zwart et al. |
| 6,392,717 | B1 | | 5/2002 | Kunzman |
| 6,393,145 | B2 | | 5/2002 | Betrisey et al. |
| 6,396,505 | B1 | | 5/2002 | Lui et al. |
| 6,441,867 | B1 | | 8/2002 | Daly |
| 6,469,766 | B2 | | 10/2002 | Waterman et al. |
| 6,545,653 | B1 | | 4/2003 | Takahara et al. |
| 6,552,706 | B1 | | 4/2003 | Ikeda et al. |
| 6,570,584 | B1 | | 5/2003 | Cok et al. |
| 6,590,555 | B2 | | 7/2003 | Su et al. |
| 6,624,828 | B1 | | 9/2003 | Dresevic et al. |
| 6,661,429 | B1 | | 12/2003 | Phan |
| 6,674,430 | B1 | | 1/2004 | Kaufman et al. |
| 6,674,436 | B1 | | 1/2004 | Dresevic et al. |
| 6,680,761 | B1 | | 1/2004 | Greene et al. |
| 6,714,206 | B1 | | 3/2004 | Martin et al. |
| 6,714,212 | B1 | | 3/2004 | Tsuboyama et al. |
| 6,714,243 | B1 | | 3/2004 | Mathur et al. |
| 6,727,878 | B2 | | 4/2004 | Okuzono et al. |
| 6,738,204 | B1 | | 5/2004 | Chuang et al. |
| 6,750,875 | B1 | | 6/2004 | Keely, Jr. et al. |
| 6,771,028 | B1 | | 8/2004 | Winters |
| 6,804,407 | B2 | | 10/2004 | Weldy |
| 6,833,890 | B2 | | 12/2004 | Hong et al. |
| 6,836,300 | B2 | | 12/2004 | Choo et al. |
| 6,850,294 | B2 | | 2/2005 | Roh et al. |
| 6,867,549 | B2 | | 3/2005 | Cok et al. |
| 6,885,380 | B1 | | 4/2005 | Primerano et al. |
| 6,888,604 | B2 | | 5/2005 | Rho et al. |
| 6,897,876 | B2 | | 5/2005 | Murdoch et al. |
| 6,903,378 | B2 | | 6/2005 | Cok |
| 6,995,346 | B2 | | 2/2006 | Johanneson et al. |
| 7,151,518 | B2 | | 12/2006 | Fukumoto |
| 2001/0015716 | A1 | | 8/2001 | Kim |
| 2001/0017607 | A1 | | 8/2001 | Kwon et al. |
| 2001/0052897 | A1 | | 12/2001 | Nakano et al. |
| 2002/0015110 | A1 | | 2/2002 | Brown |
| 2002/0093476 | A1 | | 7/2002 | Hill et al. |
| 2002/0154076 | A1 | * | 10/2002 | Greene et al. ..... 345/87 |
| 2002/0158997 | A1 | | 10/2002 | Fukami et al. |
| 2003/0006978 | A1 | | 1/2003 | Fujiyoshi |
| 2003/0011603 | A1 | | 1/2003 | Koyama et al. |
| 2003/0016310 | A1 | | 1/2003 | Lee et al. |
| 2003/0071943 | A1 | | 4/2003 | Choo et al. |
| 2003/0077000 | A1 | | 4/2003 | Blinn et al. |
| 2003/0090581 | A1 | | 5/2003 | Credelle et al. |
| 2003/0146893 | A1 | * | 8/2003 | Sawabe ..... 345/89 |
| 2003/0189537 | A1 | | 10/2003 | Yun |
| 2003/0218618 | A1 | | 11/2003 | Phan |
| 2004/0008208 | A1 | | 1/2004 | Dresevic et al. |
| 2004/0021804 | A1 | | 2/2004 | Hong et al. |
| 2004/0061710 | A1 | | 4/2004 | Messing et al. |
| 2004/0094766 | A1 | | 5/2004 | Lee et al. |
| 2004/0095521 | A1 | | 5/2004 | Song et al. |
| 2004/0104873 | A1 | | 6/2004 | Kang et al. |
| 2004/0114046 | A1 | | 6/2004 | Lee et al. |
| 2004/0150651 | A1 | | 8/2004 | Phan |
| 2004/0155895 | A1 | | 8/2004 | Lai |
| 2004/0169807 | A1 | | 9/2004 | Rho et al. |
| 2004/0174389 | A1 | | 9/2004 | Ben-David et al. |
| 2004/0179160 | A1 | | 9/2004 | Rhee et al. |
| 2004/0189662 | A1 | | 9/2004 | Frisken et al. |
| 2004/0189664 | A1 | | 9/2004 | Frisken et al. |
| 2004/0213449 | A1 | | 10/2004 | Safee-Rad et al. |
| 2004/0223005 | A1 | | 11/2004 | Lee |
| 2004/0239813 | A1 | | 12/2004 | Klompenhouwer |
| 2004/0239837 | A1 | | 12/2004 | Hong et al. |

| | | | |
|---|---|---|---|
| 2004/0246213 | A1 | 12/2004 | Credelle et al. |
| 2004/0246278 | A1 | 12/2004 | Elliott |
| 2004/0246280 | A1 | 12/2004 | Credelle et al. |
| 2004/0246381 | A1 | 12/2004 | Credelle |
| 2004/0246404 | A1 | 12/2004 | Elliott et al. |
| 2004/0247070 | A1 | 12/2004 | Ali et al. |
| 2005/0007539 | A1 | 1/2005 | Taguchi et al. |
| 2005/0024380 | A1 | 2/2005 | Lin et al. |
| 2005/0040760 | A1 | 2/2005 | Taguchi et al. |
| 2005/0068477 | A1 | 3/2005 | Shin et al. |
| 2005/0083356 | A1 | 4/2005 | Roh et al. |
| 2005/0140634 | A1 | 6/2005 | Takatori |
| 2005/0151752 | A1 | 7/2005 | Phan |
| 2005/0162600 | A1 | 7/2005 | Rho et al. |
| 2005/0219274 | A1 | 10/2005 | Yang et al. |

FOREIGN PATENT DOCUMENTS

| | | | |
|---|---|---|---|
| DE | 199 23 527 | | 11/2000 |
| DE | 201 09 354 | U1 | 9/2001 |
| EP | 0 322 106 | A2 | 6/1989 |
| EP | 1 381 020 | A2 | 1/2004 |
| JP | 60-107022 | | 6/1985 |
| JP | 02-983027 | B2 | 4/1991 |
| JP | 03-78390 | | 4/1991 |
| JP | 06-102503 | | 4/1994 |
| JP | 06-324649 | | 11/1994 |
| JP | 08-202317 | | 8/1996 |
| JP | 11-282008 | | 10/1999 |
| JP | 2004-004822 | | 1/2004 |
| WO | WO 2004/021323 | A2 | 3/2004 |
| WO | WO 2004/027503 | A1 | 4/2004 |
| WO | WO 2004/086128 | A1 | 10/2004 |
| WO | WO2005/050296 | A1 | 6/2005 |

OTHER PUBLICATIONS

Brown Elliott, C., "Color Subpixel Rendering Projectors and Flat Panel Displays," SMPTE, Feb. 27-Mar. 1, 2003, Seattle, WA pp. 1-4.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "Development of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Pentile Matrix™ Displays and Drivers" ADEAC Proceedings Paper, Portland OR., Oct. 2005.
Brown Elliott, C, "Reducing Pixel Count Without Reducing Image Quality", Information Display Dec. 1999, vol. 1, pp. 22-25.
Credelle, Thomas, "P-00: MTF of High-Resolution PenTile Matrix Displays", Eurodisplay 02 Digest, 2002 pp. 1-4.
Daly, Scott, "Analysis of Subtriad Addressing Algorithms by Visual System Models", SID Symp. Digest, Jun. 2001 pp. 1200-1203.
Klompenhouwer, Michiel, Subpixel Image Scaling for Color Matrix Displays, SID Symp. Digest, May 2002, pp. 176-179.
Krantz, John et al., Color Matrix Display Image Quality: The Effects of Luminance . . . SID 90 Digest, pp. 29-32.
Lee, Baek-woon et al., 40.5L: Late News Paper: TFT-LCD with RGBW Color system, SID 03 Digest, 2003, pp. 1212-1215.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.
Okumura et al., "A New Flicker-Reduction Drive Method for High Resolution LCTVs", SID Digest,pp. 551-554, 2001.
UPSTO, Non-Final Office Action dated Oct. 26, 2005 in US Patent Publication No. 2004/0246213 (U.S. Appl. No. 10/455,925).
Clairvoyante, Inc, Repsonse to Non-Final Office Action dated Apr. 26, 2006 in U.S. Patent Publication No. 2004/0246213 (U.S. Appl. No. 10/455,925).
UPSTO, Final Office Action dated Jun. 14, 2006 in US Patent Publication No. 2004/0246213 (U.S. Appl. No. 10/455,925).
UPSTO, Non-Final Office Action dated Oct. 19, 2004 in US Patent Publication No. 2004/0246381 (U.S. Appl. No. 10/455,931).
Clairvoyante Inc, Response to Non-Final Office Action dated Jan. 18, 2005 in US Patent Publication No. 2004/0246381 (U.S. Appl. No. 10/455,931).
UPSTO, Final Office Action dated Jul. 12, 2005 in US Patent Publication No. 2004/0246381 (U.S. Appl. No. 10/455,931).
Clairvoyante Inc, Response to Final Office Action dated Jan. 12, 2006 in US Patent Publication No. 2004/0246381 (U.S. Appl. No. 10/455,931).
UPSTO, Non-Final Office Action dated May 1, 2006 in US Patent Publication No. 2004/0246381 (U.S. Appl. No. 10/455,931).
UPSTO Non-Final Office Action dated Oct. 19, 2005 in US Patent Publication No. 2004/0246279 (U.S. Appl. No. 10/456,806).
Clairvoyante Inc, Response to Non-Final Office Action dated Jan. 18, 2005 in US Patent Publication No. 2001/0246279 (U.S. Appl. No. 10/456,806).
UPSTO, Final Office Action dated May 2, 2006 in US Patent Publication No. 2004/0246279 (U.S. Appl. No. 10/456,806).
UPSTO, Non-Final Office Action dated Mar. 20, 2006 in US Patent Publication No. 2004/0246280 (U.S. Appl. No. 10/456,839).
Clairvoyante Inc, Response to Non-Final Office Action dated Jun. 20, 2006 in US Patent Publication No. 2004/0246280 (U.S. Appl. No. 10/456,839).
UPSTO, Non-Final Office Action dated May 4, 2006 in US Patent Publication No. 2005/0083277 (U.S. Appl. No. 10/696,236).
PCT International Search Report dated Dec. 9, 2005 for PCT/US04/18034 (U.S. Appl. No. 10/455,925).
PCT International Search Report dated Feb. 1, 2006 for PCT/US04/18038 (U.S. Appl. No. 10/455,931).
PCT International Search Report dated Mar. 15, 2006 for PCT/US04/18033 (U.S. Appl. No. 10/455,927).
PCT International Search Report dated Jan. 10, 2006 for PCT/US04/18035 (U.S. Appl. No. 10/456,806).
PCT International Search Report dated Sep. 24, 2004 for PCT/US04/17796 (U.S. Appl. No. 10/456,838).
PCT International Search Report dated Nov. 3, 2004 for PCT/US04/18036 (U.S. Appl. No. 10/696,236).
Clairvoyante, Inc, Response to Final Office Action dated Nov. 10, 2006 in US Patent Publication No. 2004/0246213 (U.S. Appl. No. 10/455,925).
USPTO, non-Final Office Action dated Feb. 14, 2007 in US Patent Publication No. 2004/0246213 (U.S. Appl. NO. 10/455,925).
Clairvoyante, Inc, Response to Non-Final Office Action dated Jul. 13, 2007 in US Patent Publication No. 2004/0246213 (U.S. Appl. No. 10/455,925).
USPTO, Final Office Action dated Aug. 30, 2007 in US Patent Publication No. 2004/0246213 (U.S. Appl. No. 10/455,925).
Clairvoyante Inc, Response to Non-Final Office Action dated Oct. 2, 2006 in US Patent Publication No. 2004/0246381 (U.S. Appl. No. 10/455,931).
USPTO, Non-Final Office Action dated Jan. 23, 2006 in US Patent No. 7,209,105 (U.S. Appl. NO. 10/455,927).
Clairvoyante Inc, Response to Non-Final Office Action dated May 19, 2006 in US. Patent No. 7,209,105 (U.S. Appl. No. 10/455,927).
USPTO, Final Office Action dated Aug. 9, 2006 in US Patent No. 7,209,105 (U.S. Appl. No. 10/455,927).
Clairvoyante Inc, Response to Non-Final Office Action dated Nov. 20, 2006 in U.S. Appl. No. 7,209,105 (U.S. Appl. No. 10/455,927).
Clairvoyante Inc, Response to Final Office Action dated Aug. 2, 2006 In US Patent No. 7,187,353 (U.S. Appl. No. 10/456,806).
USPTO, Notice of Allowance, dated Sep. 18, 2006 in US Patent No. 7,187,353 (U.S. Appl. No. 10/456,806).
USPTO, Non-Final Office Action dated Sep. 2, 2004 in US Patent Publication NO. 2004/0246404 (U.S. Appl. No. 10/456,838).
Clairvoyante Inc, Response to Non-Final Office Action dated Jan. 28, 2005 in US Patent Publication No. 2004/0246404 (U.S. Appl. NO. 10/456,838).
USPTO, Final Office Action dated Jun . 9, 2005 in US Patent Publication No. 2004/0246404 (U.S. Appl. No. 10/456,838).

Clairvoyante Inc, Response to Final Office Action dated Dec. 5, 2005 in US Patent Publication No. 2004/0246404 (U.S. Appl. No. 10/456,838).
USPTO, Non-Final Office Action dated Mar. 20, 2006 in US Patent Publication No. 2004/0246404 (U.S. Appl. No. 10/456,838).
Clairvoyante Inc, Response to Non-Final Office Action dated Sep. 14, 2006 in US Patent Publication No. 2004/0246404 (U.S. Appl. No. 10/456,838).
USPTO, Final Office Action dated Jan. 18, 2007 in US Patent Publication No. 2004/0246404 (U.S. Appl. No. 10/456,838).
Clairvoyante Inc, Response to Final Office Action dated Jun. 18, 2007 in US Patent Publication No. 2004/0246404 (U.S. Appl. No. 10/456,838).
USPTO, Non-Final Office Action dted Jul. 27, 2007 in US Patent Publication No. 2004/0246404 (U.S. Appl. No. 10/456,838).
Clairvoyante Inc, Response to Non-Final Office Action dated Jan. 28, 2008 in U S Patent Publication No. 2004/0246404 (U.S. Appl. No. 10/456,838).
USPTO, Final Office Action dated Aug. 29, 2006 in US Patent Publication No. 2004/0246280 (U.S. Appl. No. 10/456,839).
Clairvoyante Inc, Response to Final Office Action dated Feb. 21, 2007 in US Patent Publication No. 2004/0246280 U.S. Appl. No. 10/456,839).
USPTO, Non-Final Office Action dated May 16, 2007 in US Patent Publication No. 2004/0246280 (U.S. Appl. NO. 10/456,839).
Clairvoyante Inc, Response to Non-Final Office Action dated Aug. 4, 2006 in US Patent Publication No. 2005/0083277 (U.S. Appl. No. 10/696,236).
USPTO, Final Office Action dated Oct. 17, 2006 in US Patent Publication No. 2005/0083277 (U.S. Appl. No. 10/696,236).
Clairvoyante Inc, Response to Final Office Action dated Mar. 16, 2007 in US Patent Publication No. 2005/0083277 (U.S. Appl. No. 10/696,236).
USPTO, Non-Final Office Action dated May 23, 2007 in US Patent Publication No. 2005/0083277 (U.S. Appl. No. 10/696,236).

* cited by examiner

Φ1: +-+-+-...

Φ2: -+-+-+...

SYSTEM AND METHOD FOR COMPENSATING FOR VISUAL EFFECTS UPON PANELS HAVING FIXED PATTERN NOISE WITH REDUCED QUANTIZATION ERROR

RELATED APPLICATIONS

This application is a divisional of, and claims priority to, U.S. patent application Ser. No. 10/455,927 filed on Jun. 6, 2003, and issued as U.S. Pat. No. 7,209,105. U.S. Ser. No. 10/455,927 was published as US Patent Application Publication No. 2004/0246278 which is hereby incorporated by reference herein for all that it teaches The present application is related to commonly owned United States Patent Applications: (1) U.S. patent application Ser. No. 10/455,925 entitled "DISPLAY PANEL HAVING CROSSOVER CONNECTIONS EFFECTING DOT INVERSION" and published as U.S. Patent Publication No. 2004/0246213 ("the '213 application"); (2) U.S. patent application Ser. No. 10/455,931 entitled "SYSTEM AND METHOD OF PERFORMING DOT INVERSION WITH STANDARD DRIVERS AND BACKPLANE ON NOVEL DISPLAY PANEL LAYOUTS" and published as U.S. Patent Publication No. 2004/0246381 ("the '381 application"); (3) U.S. patent application Ser. No. 10/456,806 entitled "DOT INVERSION ON NOVEL DISPLAY PANEL LAYOUTS WITH EXTRA DRIVERS" and published as U.S. Patent Publication No. 2004/0246279 ("the '279 application"); (4) U.S. patent application Ser. No. 10/456,838 entitled "LIQUID CRYSTAL DISPLAY BACKPLANE LAYOUTS AND ADDRESSING FOR NON-STANDARD SUBPIXEL ARRANGEMENTS" and published as U.S. Patent Publication No. 2004/0246404 ("the '404 application") and (5) U.S. patent application Ser. No. 10/456,839 entitled "IMAGE DEGRADATION CORRECTION IN NOVEL LIQUID CRYSTAL DISPLAYS," and published as U.S. Patent Publication No. 2004/0246280 ("the '280 application") which are hereby incorporated herein by reference.

BACKGROUND

In commonly owned United States Patent Applications: (1) U.S. patent application Ser. No. 09/916,312 entitled "ARRANGEMENT OF COLOR PIXELS FOR FULL COLOR IMAGING DEVICES WITH SIMPLIFIED ADDRESSING," filed Jul. 25, 2001 and issued as U.S. Pat. No. 6,903,754 ("the '754 patent"); (2) U.S. patent application Ser. No. 10/278,353 entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002 and published as U.S. Patent Publication No. 2003/0128225 ("the '225 application"); (3) U.S. patent application Ser. No. 10/278,352 entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002 and published as U.S. Patent Publication No. 2003/0128179 ("the '179 application"); (4) U.S. patent application Ser. No. 10/243,094 entitled "IMPROVED FOUR COLOR ARRANGEMENTS AND EMITTERS FOR SUB-PIXEL RENDERING," filed Sep. 13, 2002 and published as U.S. Patent Publication No. 2004/0051724 ("the '724 application"); (5) U.S. patent application Ser. No. 10/278,328 entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002 and published as U.S. Patent Publication No. 2003/0117423 ("the '423 application"); (6) U.S. patent application Ser. No. 10/278,393 entitled "COLOR DISPLAY HAVING HORIZONTAL SUB-PIXEL ARRANGEMENTS AND LAYOUTS," filed Oct. 22, 2002 and published as U.S. Patent Publication No. 2003/0090581 ("the '581 application"); (7) U.S. patent application Ser. No. 10/347,001 entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, and published as Patent Publication No. 2004/0080479 ("the '479 application"); novel sub-pixel arrangements are therein disclosed for improving the cost/performance curves for image display devices and herein incorporated by reference.

These improvements are particularly pronounced when coupled with sub-pixel rendering (SPR) systems and methods further disclosed in those applications and in commonly owned United States Patent Applications: (1) U.S. patent application Ser. No. 10/051,612 entitled "CONVERSION OF A SUB-PIXEL FORMAT DATA TO ANOTHER SUB-PIXEL DATA FORMAT," filed Jan. 16, 2002 and published as U.S. Patent Publication No. 2003/0034992 ("the '992 application"); (2) U.S. patent application Ser. No. 10/150,355 entitled "METHODS AND SYSTEMS FOR SUB-PIXEL RENDERING WITH GAMMA ADJUSTMENT," filed May 17, 2002 and published as U.S. Patent Publication No. 2003/0103058 ("the '058 application"); (3) U.S. patent application Ser. No. 10/215,843 entitled "METHODS AND SYSTEMS FOR SUB-PIXEL RENDERING WITH ADAPTIVE FILTERING," filed Aug. 8, 2002 and published as U.S. Patent Publication No. 2003/0085906 ("the '906 application"); (4) U.S. patent application Ser. No. 10/379,767 entitled "SYSTEMS AND METHODS FOR TEMPORAL SUB-PIXEL RENDERING OF IMAGE DATA" filed Mar. 4, 2003 and published as U.S. Patent Publication No. 2004/0196302 ("the '302 application"); (5) U.S. patent application Ser. No. 10/379,765 entitled "SYSTEMS AND METHODS FOR MOTION ADAPTIVE FILTERING," filed Mar. 4, 2003 and issued as U.S. Pat. No. 7,167,186 ("the '186 patent"); (6) U.S. patent application Ser. No. 10/379,766 entitled "SUB-PIXEL RENDERING SYSTEM AND METHOD FOR IMPROVED DISPLAY VIEWING ANGLES" filed Mar. 4, 2003 and issued as U.S. Pat. No. 6,917,368 ("the '368 patent") (7) U.S. patent application Ser. No. 10/409,413 entitled "IMAGE DATA SET WITH EMBEDDED PRE-SUBPIXEL RENDERED IMAGE" filed Apr. 7, 2003, and published as Patent Publication No. 2004/0196297 ("the '297 application") which are hereby incorporated herein by reference.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1A:
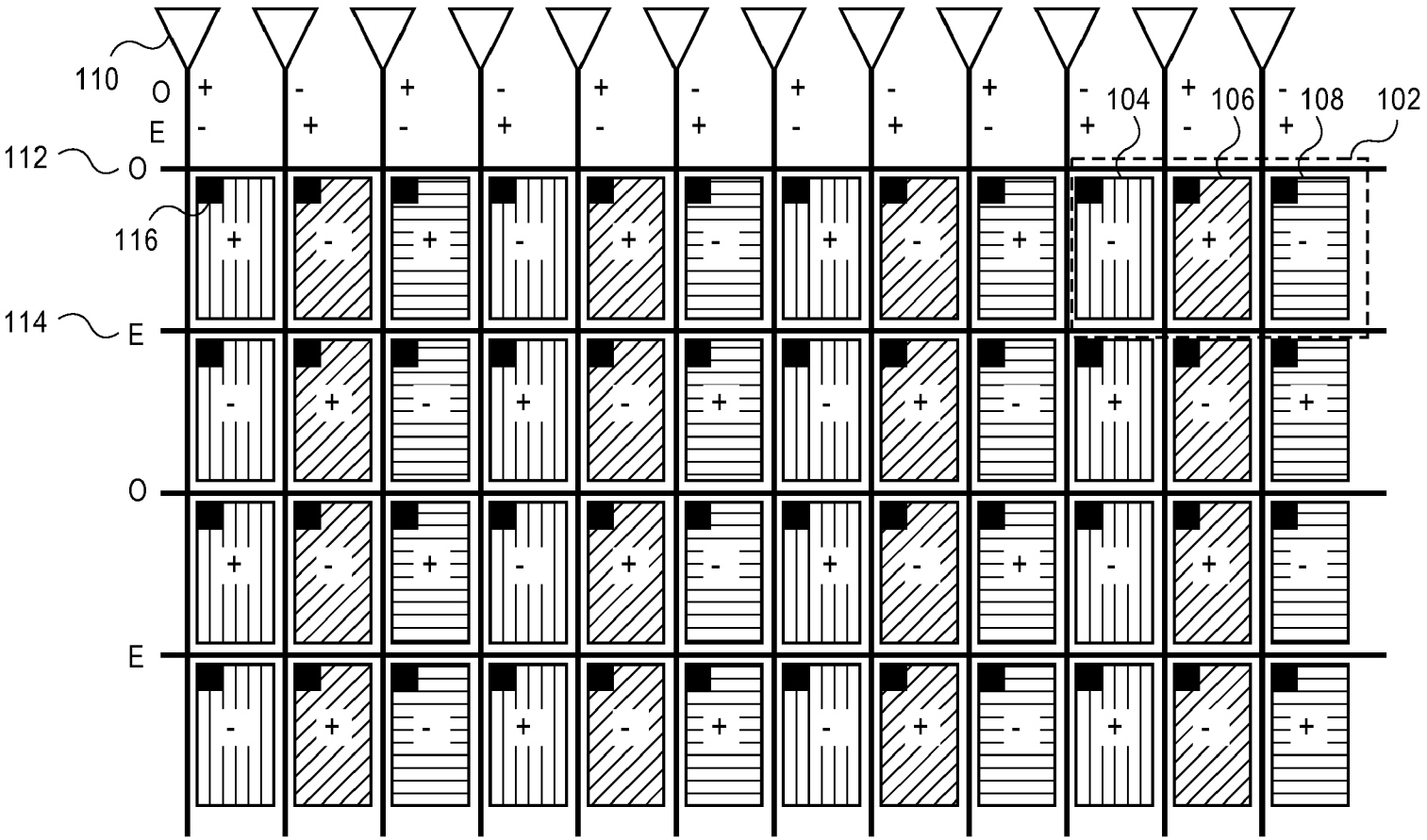
FIG. 1A (PRIOR ART)
FIG. 1A depicts a typical RGB striped panel display having a standard 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel form a repeating group of subpixels 102 that comprise the panel.

As also shown, each subpixel is connected to a column line (each driven by a column driver 110) and a row line (e.g. 112 and 114). In the field of AMLCD panels, it is known to drive the panel with a dot inversion scheme to reduce crosstalk or flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("O") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
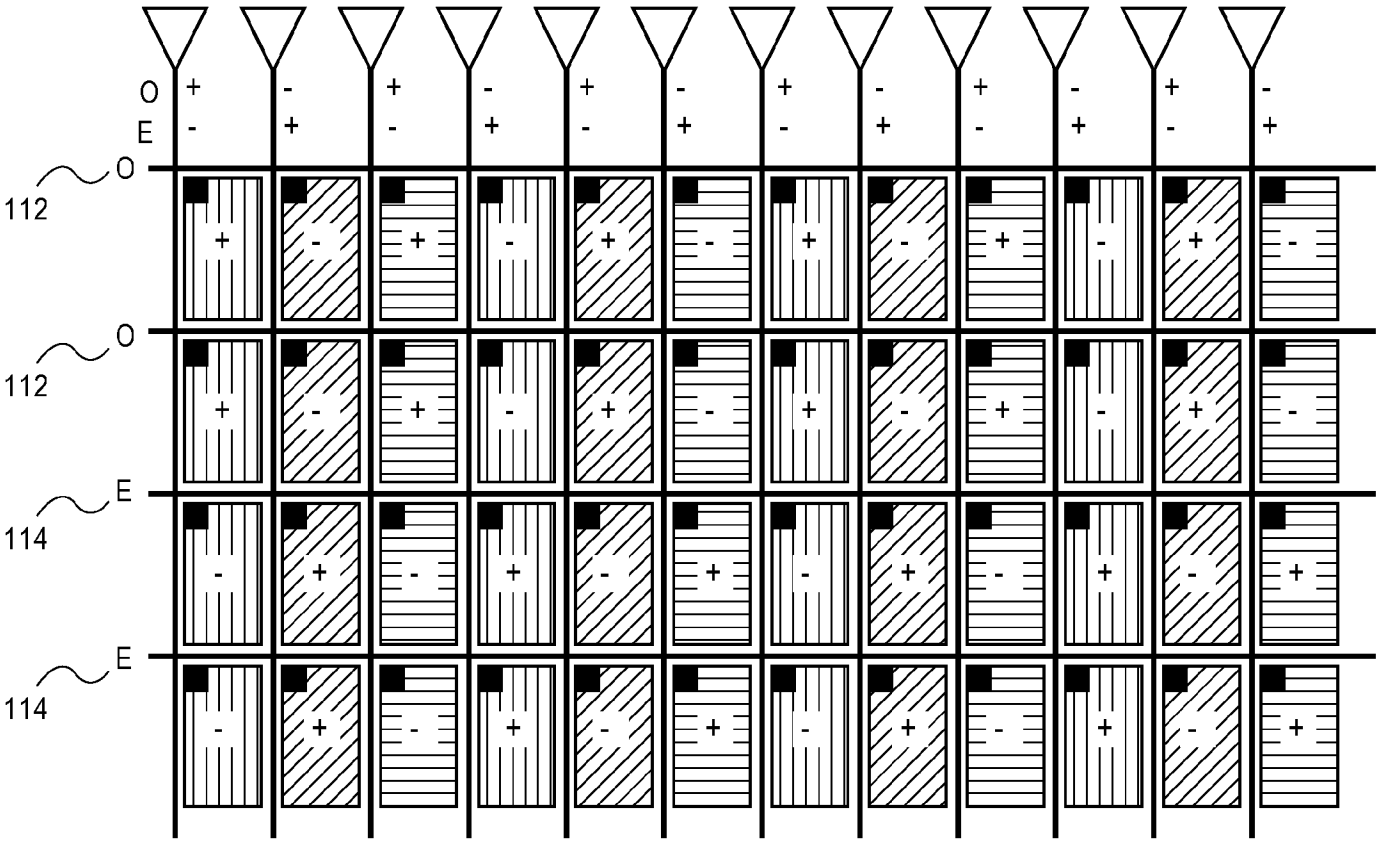
FIG. 1B (PRIOR ART)
FIG. 1B depicts a typical RGB striped panel display having a standard 1×2 dot inversion scheme.

FIG. 1B depicts another conventional RGB stripe panel having another dot inversion scheme—i.e. 1×2 dot inversion. Here, the polarity scheme changes over the course of two rows—as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, for example, two successive red subpixels along a row will be either (+,−) or (−,+). Of course, in 1×1 dot inversion, two successive red subpixels along a column with have opposite polarity; whereas in 1×2 dot inversion, each group of two successive red subpixels will have opposite polarity. This changing of polarity decreases noticeable visual effects that occur with particular images rendered upon an AMLCD panel.

Figure 2:
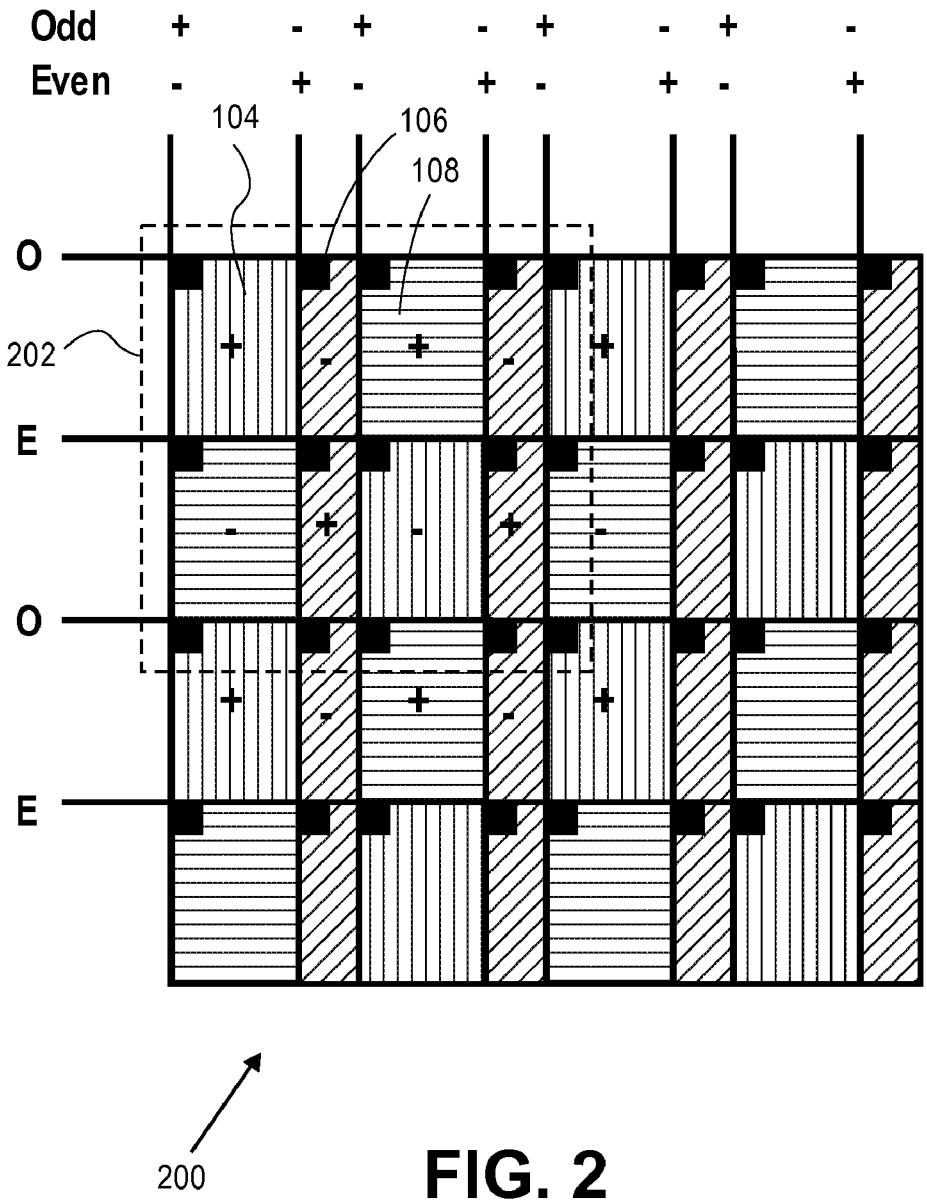
FIG. 2 depicts a novel panel display comprising a subpixel repeat grouping that is of even modulo.

FIG. 2 shows a panel comprising a repeat subpixel grouping 202, as further described in US Patent Publication No. 2003/0128225. As may be seen, repeat subpixel grouping 202 is an eight subpixel repeat group, comprising a checkerboard of red and blue subpixels with two columns of reduced-area green subpixels in between. If the standard 1×1 dot inversion scheme is applied to a panel comprising such a repeat grouping (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeating groups—for example, the subpixel repeat grouping in FIG. 1 of US Patent Publication No. 2003/0128179—and other repeat groupings that are not an odd number of repeating subpixels across a row. Thus, as the traditional RGB striped panels have three such repeating subpixels in its repeat group (namely, R, G and B), these traditional panels do not necessarily violate the above noted conditions. However, the repeat grouping of FIG. 2 in the present application has four (i.e. an even number of) subpixels in its repeat group across a row (e.g. R, G, B, and G). It will be appreciated that the embodiments described herein are equally applicable to all such even modulus repeat groupings.

Figure 3:
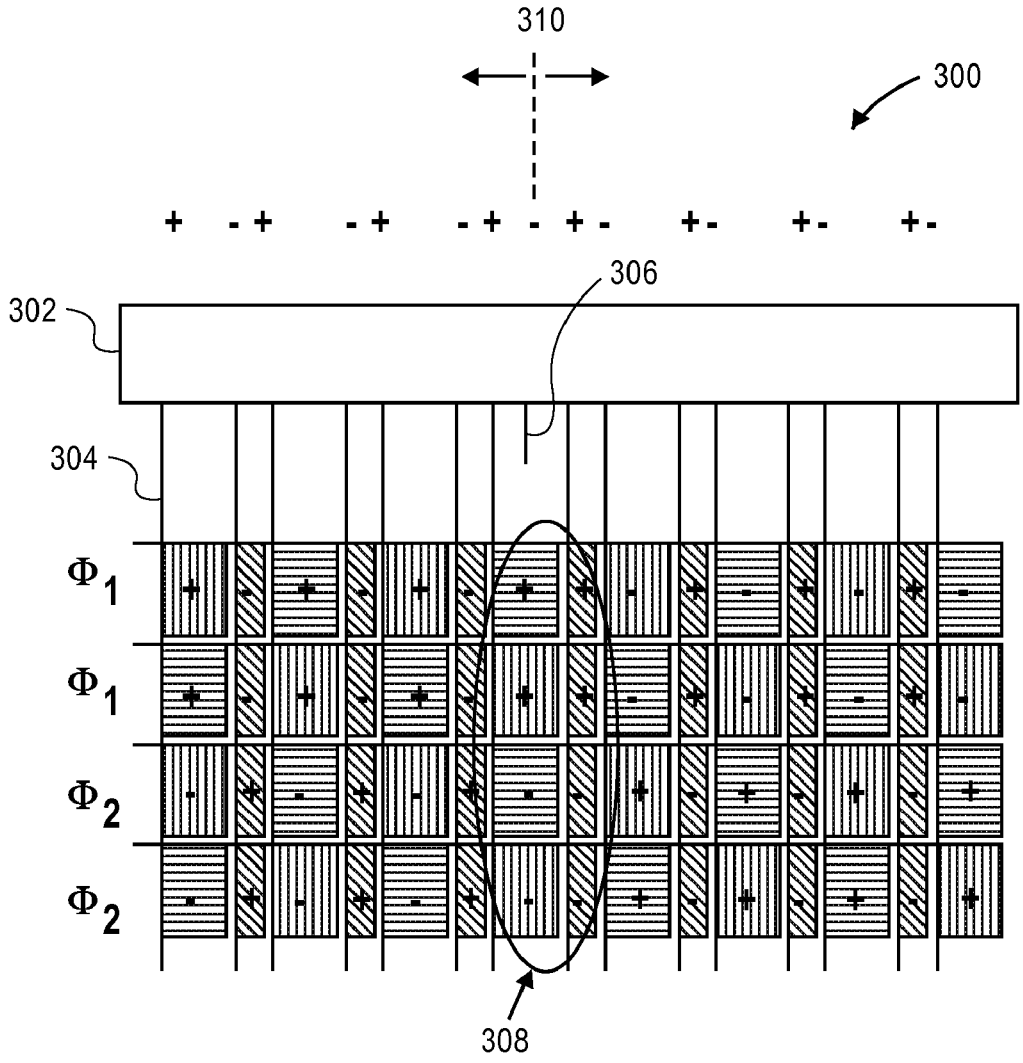
FIG. 3 depicts the panel display of FIG. 2 with one column driver skipped to provide a dot inversion scheme that may abate some undesirable visual effects; but inadvertently create another type of undesirable effect.
Figure 4:
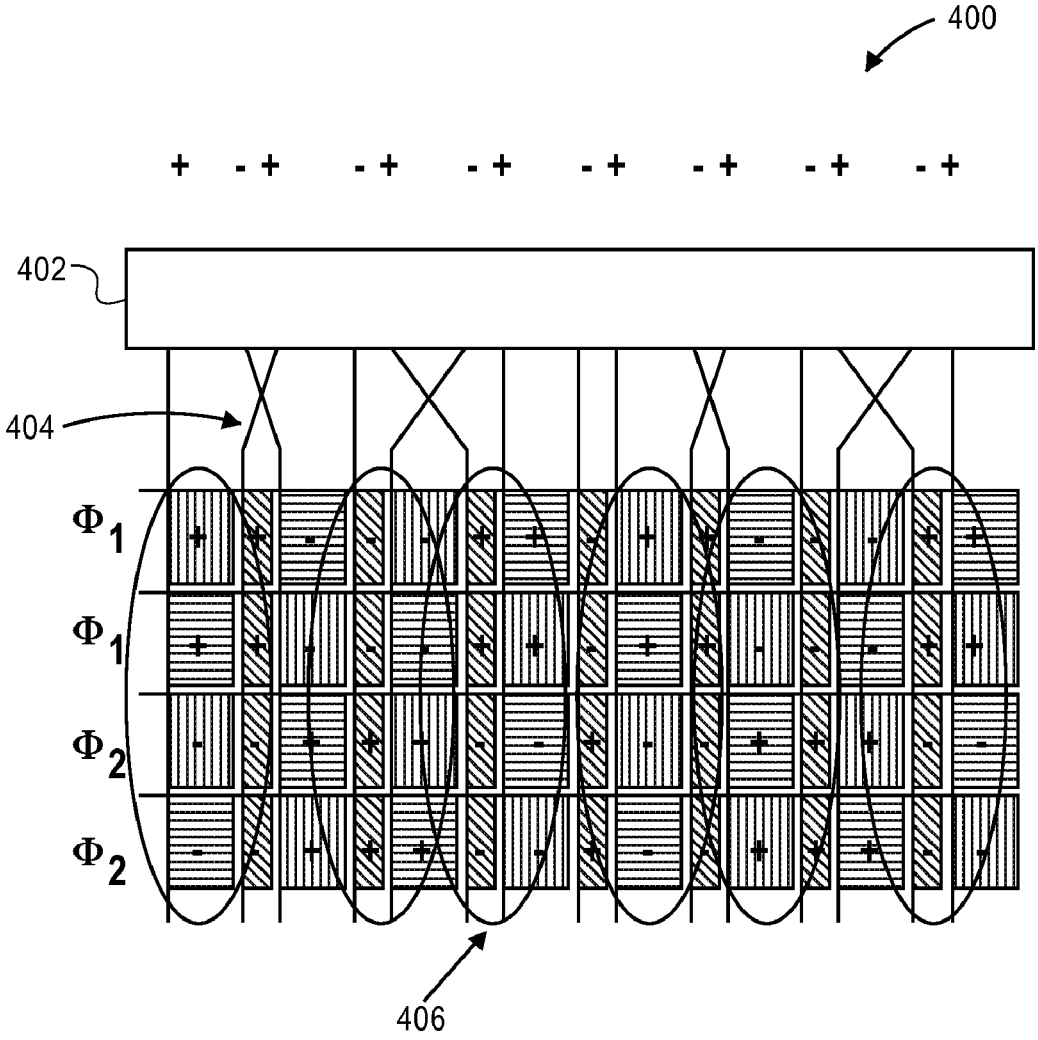
FIG. 4 depicts a panel whereby crossovers might create such an undesirable visual effect.
Figure 5:
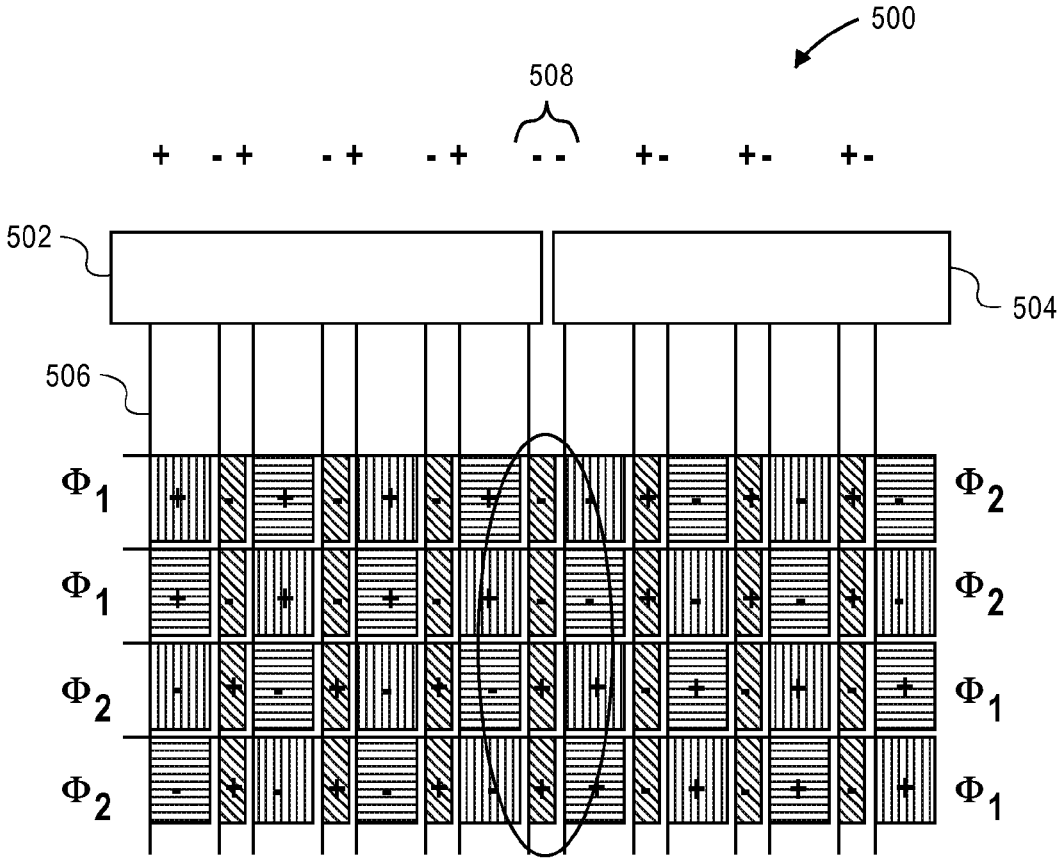
FIG. 5 depicts a panel whereby columns at the boundary of two column chip drivers might create an undesirable visual effect.

In several co-pending applications, e.g., the applications entitled "DISPLAY PANEL HAVING CROSSOVER CONNECTIONS EFFECTING DOT INVERSION" now published as US Patent Publication No. 2004/02463281 and "SYSTEM AND METHOD OF PERFORMING DOT INVERSION WITH STANDARD DRIVERS AND BACKPLANE ON NOVEL DISPLAY PANEL LAYOUTS," now published as US Patent Publication No. 2004/0246381 there are disclosed various techniques that attempt to solve the dot inversion problem on panels having even-modulo subpixel repeating groups. FIGS. 3 through 5 detail some of the possible techniques and solutions disclosed in those applications.

FIG. 3 shows panel 300 comprises the subpixel repeating group as shown in FIG. 2. Column driver chip 302 connects to panel 300 via column lines 304. Chip 302, as shown, effects a 1×2 dot inversion scheme on panel 300—as indicated by the "+" and "−" polarities indicated in each subpixel. As may be seen, at certain points along chip 302, there are column drivers that are not used (as indicated by short column line 306). "Skipping" a column driver in such a fashion creates the desirable effect of providing alternating areas of dot inversion for same colored subpixels. For example, on the left side of dotted line 310, it can be seen that the red colored subpixels along a given row have the same polarity. However, on the right side of dotted line 310, the polarities of the red subpixels change. This change may have the desired effect of eliminating or abating any visual shadowing effects that might occur as a result of same-colored subpixel polarities. However, having two columns (as circled in element 308) driven with the same polarity may create an undesirable visual effect (e.g. possibly darker columns than the neighboring columns).

FIG. 4 shows yet another possible solution. Panel 400 is shown comprising a number of crossover connections 404 from a (possibly standard) column driver chip 402. As noted in the co-pending application entitled "DISPLAY PANEL HAVING CROSSOVER CONNECTIONS EFFECTING DOT INVERSION," these crossovers may also create undesirable visual effects—e.g. for the columns circled as in element 406.

FIG. 5 is yet another possible solution, as noted in the above co-pending application entitled "SYSTEM AND METHOD OF PERFORMING DOT INVERSION WITH STANDARD DRIVERS AND BACKPLANE ON NOVEL DISPLAY PANEL LAYOUTS," now published as US Patent Publication No. 2004/0246381. Panel 500 is shown being driven by at least two column driver chips 502 and 504. Column lines 506 supply image data to the subpixels in the panel. At the boundary 508 between the two chips, the second chip is driven with the dot inversion polarity out of phase with the first chip, producing the dot inversion scheme as noted. However, the two adjacent column lines at the boundary 508 are driven with the same polarity down the column—possibly causing an undesirable visual effect as previously noted.

Although the above solutions possibly introduce visual effects that, if noticeable, might be detracting, these solutions share one common trait—the visual effects occur at places (e.g., chip boundaries, crossovers, etc) that are well known at the time of panel manufacture. Thus, it is possible to plan for and correct (or at least abate) these effects, so that it does not negatively impact the user.

In such cases, the panels at issue exhibit a visual image distortion that might be described as a "fixed pattern noise" in which the Electro-Optical (EO) transfer function for a subset of the pixels or subpixels is different, perhaps shifted, from another subset or subsets. This fixed pattern noise, if uncompensated, may cause an objectionable image if the differences are large. However, as disclosed herein, even these large differences may be advantageous in reducing quantization noise artifacts such as false contours, usually caused by insufficient grey scale depth.

Another source of the fixed pattern noise that is usually inadvertent and/or undesirable results from the differences in subpixel electrical parasitics. For example, the difference in parasitics may be the result of shifting the position or size of the Thin Film Transistor (TFT) or storage capacitor in an active matrix liquid crystal display (AMLCD). Alternatively, the fixed pattern noise may be deliberate on the part of the designer, such as adjusting the aperture ratio of the subpixels, or the transmittance of a color or polarizer filter. The aperture ratio may be adjusted using any single or combination of adjustments to the design of the subpixels, most notably the 'black matrix' used in some LCD designs. The techniques disclosed here may be used on any suitable pixelated or subpixelated display (monochrome or color).

In one embodiment, these two different sources of fixed pattern noise may give rise to two forms of EO difference. One form might be a linear shift, as might happen when the aperture ratio is different for the subsets. The other is a shift in the shape of the EO curve, as might happen in a difference of parasitics. Both may be adjusted via quantizing look-up tables ("LUTs") storing bit depth values, since the LUTs are a complimentary (inverse) function.

Since the pattern noise is usually predictable and/or measurable, one possible embodiment is to provide separate quantizers for each subset of pixels or subpixels, matched to the EO transfer function of each subset. One suitable quantizer in a digital system could be implemented as a look-up table (LUT) that converts a greater bit depth value to a smaller bit depth value. The large bit depth value may be in a subpixel rendering or scaling system. The large bit depth value may be in a linear luminance space or any arbitrary space encoding.

Figure 6:
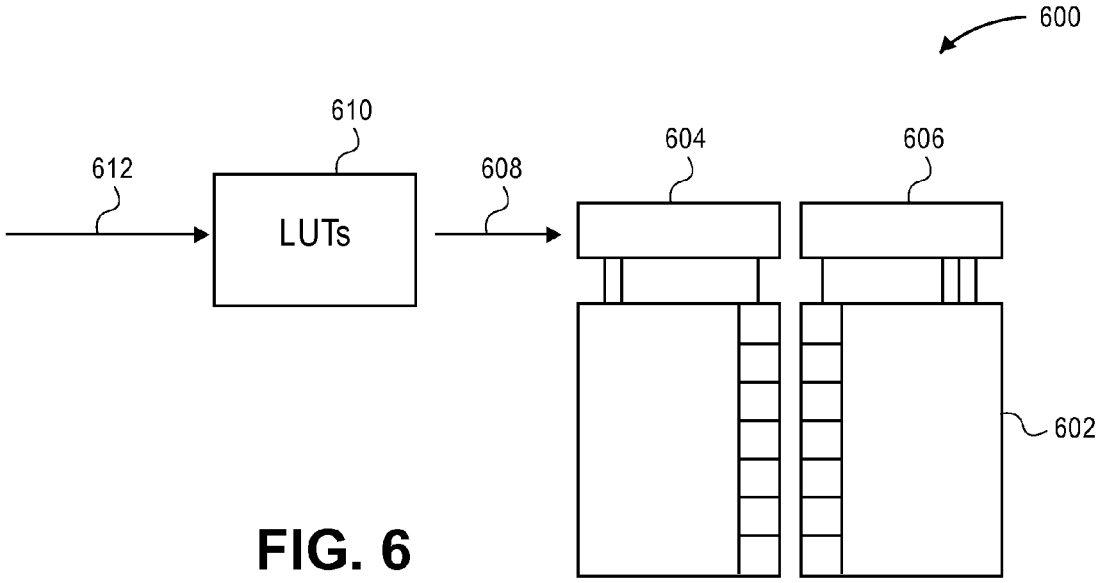
FIG. 6 is one embodiment of a system comprising a set of look-up tables that compensate for the undesirable visual effects introduced either inadvertently or as a deliberate design choice.

FIG. 6 is only one possible example of a system employing a LUT to correct for a given fixed pattern noise. Display 600 comprises a panel 602 that is being driven by at least two chips 604 and 606 wherein a possible fixed pattern noise is introduced at the chip boundary that might make the boundary columns darker than other neighboring columns. In this display, however, image data 612 that is to be rendered upon the panel is first passed through a set of LUTs 610 that will apply the appropriate quantizer for the appropriate subpixels on the panel. This image data 608 is then passed to the column drivers for rendering on the panel.

Figure 7:
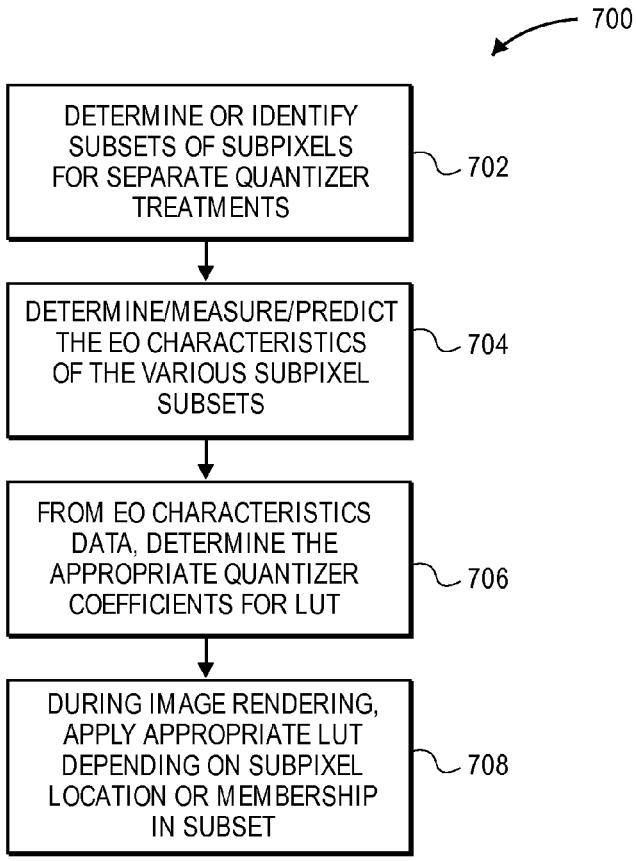
FIG. 7 is one embodiment of a flowchart for designing a display system that comprising look-up tables to correct visual effects.

FIG. 7 depicts one possible embodiment 700 of the present invention that implements appropriate LUTs. At step 702, determine or otherwise identify the subsets of subpixels that would qualify for different quantizer application. At step 704, determine, measure, or otherwise predict the EO characteristics of the various subpixel subsets. At step 706, from the EO characteristics data, determine the appropriate quantizer coefficients for each appropriate LUT. At step 708, apply the appropriate LUT to the image data to be rendered on the panel, depending on subpixel location or otherwise membership in a given subset.

Having separate LUTs not only compensates for the fixed pattern noise, but since each combination of subpixel subset and LUT quantizes (changes output) at different inputs, the effective grey scale of the display system is increased. The subsets need not be quantizing exactly out of step, nor uniformly out of step, for improvement to be realized, though it helps if they are. The number of subsets may be two or more. More subsets increases the number of LUTs, but also increases the benefit of the quantization noise reduction and increased grey scale reproduction since each subset would be quantizing at different input levels.

Therefore it may be advantageous to deliberately introduce fixed pattern noise, using two or more subsets of EO transfer functions per subpixel color, preferably distributed evenly across the entire display. Since green is usually responsible for the largest percentage of luminance perception, having multiple subsets of green will increase the luminance grey scale performance. Having two or more subsets in red further increases the luminance grey scale performance, but to a lesser degree. However, having increases in any color, red, green, or blue, increases the number of colors that may be represented without color quantization error.

The fixed pattern noise may be large or small amplitude. If small, it may not have been visible without the matched quantizers; but the improvement in grey scale would still be realized with the matched quantizers. If the amplitude is large, the noise may be very visible, but with the matched quantizers, the noise is canceled, reduced to invisibility and the grey scale improved at the same time. The use of multiple quantizers may be combined with high spatiotemporal frequency noise added to the large bit depth values to further increase the performance of the system, the combination of the two providing greater performance than either alone. Alternatively, the multiple quantizers may be in combination with temporal, spatial, or spatio-temporal dithering.

Figure 8:
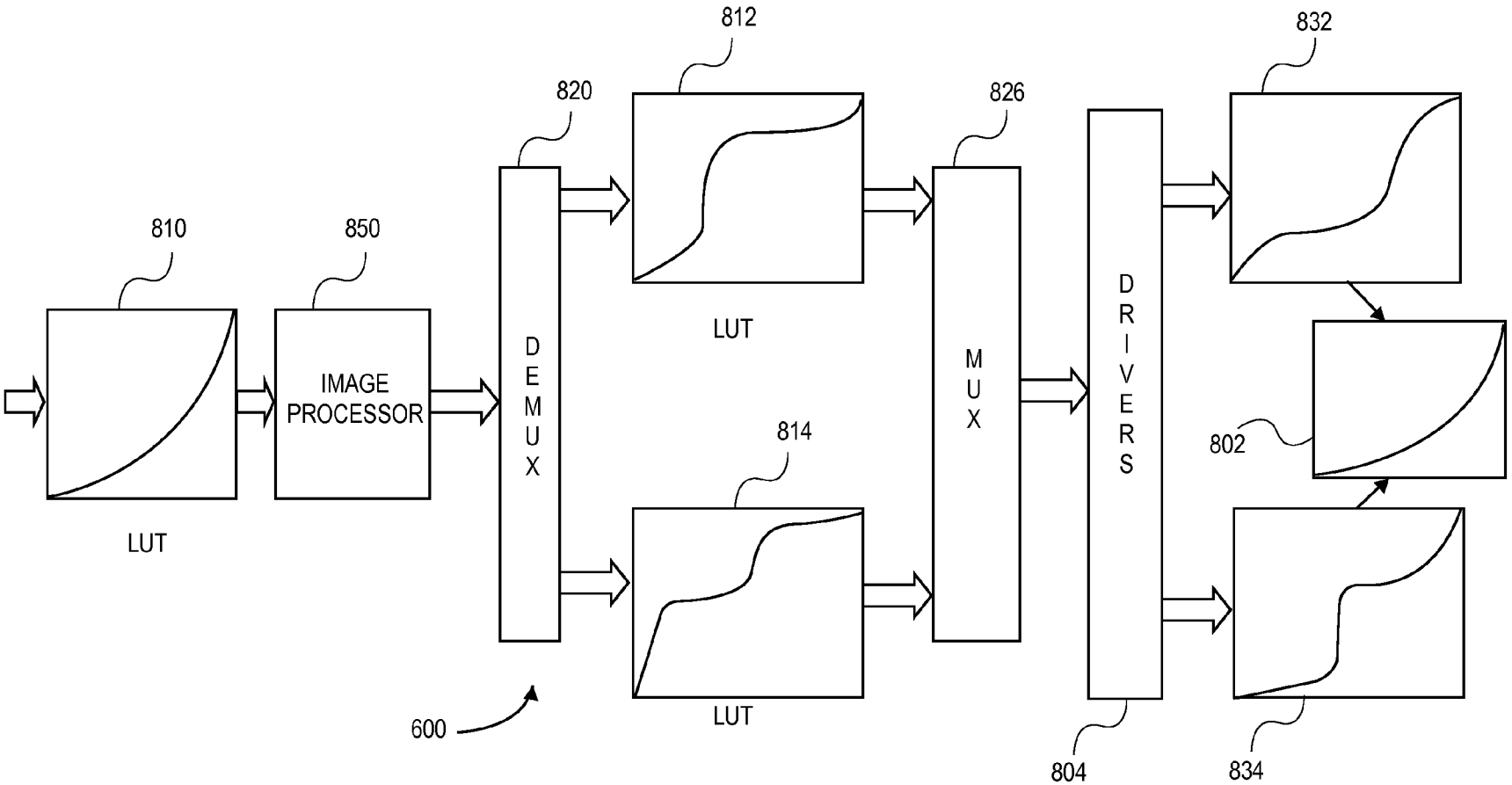
FIG. 8 is another embodiment of a system comprising look-up tables that compensate for a plurality of electro-optical transfer curves and provide reduced quantization error.

The advantage of reduction of quantization noise is considerable when a system uses lower grey scale drivers than the incoming data provides. However, as can be seen in FIG. 8, even for systems that use the same grey scale bit depth as the incoming data of the system, benefits may be seen in better control of the overall transfer function (gamma), by allowing an input gamma adjustment LUT 810 to set the display system gamma, while the output quantizers 812 and 814 exactly match and complement, thus cancel the EO transfer functions, 832 and 834 respectively, of the actual display device, with fidelity greater than the bit depth of the drivers due to the added benefit of the reduction of quantization noise. Thus, one may have an input LUT 810 that converts the incoming data to some arbitrarily larger bit depth, followed by any optional data processing 850 such as scaling or subpixel rendered data or not, then followed by conversion via the matched LUTs 832 and 834 to the subsets of pixels or subpixels. This might provide an improved gamma (transfer function) adjustment with reduced quantization noise since one subset will be switching state at a different point than another point or other points.

Examining FIG. 8 will allow this aspect of the invention to be better understood. In the figure, the transfer curve implemented in each of the LUTs, 810, 812, and 814, are shown graphically as continuous lines. It is to be understood that in fact this is a set of matched discrete digital numbers. The EO curves for the subsets of pixels or subpixels, 832 and 834, are similarly graphically represented by continuous curves. It is to be understood that when in operation the drivers 804 convert digital numbers into a limited set of analog voltages, pulse widths, current, or other suitable display modulation means.

An incoming signal 810 with a given bit depth is converted to a greater bit depth and is simultaneously impressed with the desired display system gamma curve by the incoming LUT 810. This is followed by any desired image processing step 850 such as subpixel rendering, scaling, or image enhancement. This is followed by a suitable means for selecting the appropriate LUT (812 or 814) for the given pixel or subpixel, herein represented as a demux circuit element 820. This element may be any suitable means known in the art. Each subset is then quantized by LUTs 812 and 814 to a lower bit depth matching that used by display driver chips 804 of the display device system. Each of these LUTs 812 and 814 has a set of paired numbers that are generated to serve as the inverse or complementary function of the matching EO curves 832 and 834 respectively. When these values are used to select the desired brightness or color levels of each subset, the resulting overall display system transfer curve 802 is the same as that of the incoming LUT 810. Following the output gamma compensation LUTs 812 and 814 is a means 826 for combining the results, herein represented as a mux, of the multiple LUTs 812 and 814 to send to the display drivers 804.

Special note should be taken of the nature of the EO curve difference and the desired behavior in the case of an even image field at the top of the value range. For example, in the case of a text based display where it is common to display black text on a white background, the even quality of the white background is highly desirable. In such a case, the brightness level of the darkest subset of pixels or subpixels will determine the highest level to which the brighter subsets will be allowed to proceed, given sufficient quantizer steps to equalize at this level. This may of necessity lead to lost levels above this nominally highest level, for the brighter subset(s). Another case might be handled differently, for example, for television images, the likelihood of an even image field at the top of the value range is reasonably low, (but not zero). In this case, allowing the top brightness of the brighter subset(s) to exceed that of the lowest subset may be acceptable, even desirable, provided that all levels below that are adjusted to be the same per the inventive method described herein.

It should also be noted that it may be desirable, due to different EO curves for different colors, that each color have its own quantizing LUT. There may be different EO subset within each color subset per the present invention. It may be desirable to treat each color differently with respect to the above choices for handling the highest level settings. For example, blue may be allowed to exhibit greater differences between subsets than green or red, due to the human vision system not using blue to detect high spatial frequency luminance signals.

Furthermore, it should be understood that this system may use more than two subsets to advantage, the number of LUTs and EO curves being any number above one. It should also be understood by those knowledgeable in the art, that the LUTs may be substituted by any suitable means that generates the same, or similar, output function. This may be performed as an algorithm in software or hardware that computes, or otherwise delivers, the inverse of the display subset EO curves. LUTs are simply the means of choice given the present state of art and its comparative cost structure. It should also be further understood, that while FIG. 8 shows a demux 820 and mux 826, any suitable means for selecting and directing the results of the multiple LUTs or function generator may be used. In fact, the entire system may be implemented in software running on a general purpose or graphics processor.

The implementation, embodiments, and techniques disclosed herein work very well for liquid crystal displays that have different regions of subpixels having different EO characteristics—e.g. due to dot inversion schemes imposed on panels have an even number of subpixels in its repeating group or for other parasitic effects. It should be appreciated, however, that the techniques and systems described herein are applicable for all display panels of any different type of technology base—for example, OLED, EL, plasma and the like. It suffices that the differences in EO performance be somewhat quantifiable or predictable in order to correct or adjust the output signal to the display to enhance user acceptability, while at the same time, reduce quantizer error.

What is claimed is:

1. A display system comprising:

a display panel having a plurality of subpixels;

driver circuitry providing image data signals and polarity signals to said subpixels; and at least one look-up table (LUT) configured to store data values for driving the subpixels on the display panel; said data values correcting for fixed pattern noise signals caused by a plurality of said subpixels having a substantially same color being driven by identical polarity signals in image data values sent to said subpixels.

2. The display system of claim 1, further comprising at least two driver chips receiving data values from said LUT and driving the panel with the data values from the LUT.

3. A display system comprising:

a panel having a plurality of subpixels;

a first look-up table (LUT) configured to provide gamma adjustment signals to input image data;

an image processor configured to receive the gamma adjusted input image data for processing;

a demultiplexer configured to receive and demultiplex the processed image data from the image processor;

a second LUT and a third LUT configured to receive the demultiplexed image data from the demultiplexer, the second and third LUTs correcting fixed noise patterns in the demultipixed image data;

a multiplexer configured to receive and multiplex image data from the second and third LUTs;

a driver configured to receive the multiplexed image data from the multiplexer and to provide driving image data; and a fourth LUT and a fifth LUT configured to receive the driving image data from the driver, the fourth and fifth LUTs adjusting the driving image data for display on the panel.

4. The display system of claim 3 wherein said second and third LUTs reduce a bit depth of said demultiplxed image data to a bit depth required by said driver.

5. The display system of claim 3 wherein said fourth and fifth LUTs provide output gamma adjustment signals to said driving image data; and wherein said adjusted data signals provided by said second and third LUTs to said demultiplxed image data are the inverse of said output gamma adjustment signals.

6. A display system comprising:

a display panel having a plurality of subpixels for displaying an output image;

a first look-up table (LUT) configured to provide gamma adjustment signals to input image data to produce gamma adjusted input image data having an intermediate bit depth greater than a bit depth of said input image data;

an image processor configured to receive said gamma adjusted input image data for processing; said image processor producing output image data for rendering on said subpixels of said display panel;

a demultiplexer configured to receive said output image data from the image processor; said demultiplexer selecting at least two subsets of output image data;

a second LUT and a third LUT configured to each respectively receive one of said at least two subsets of output image data from the demultiplexer; each of said second and third LUTs applying adjusted data values to a respective one of said subsets of output image data; each of said second and third LUTs further converting said intermediate bit depth of said output image data to an output bit depth;

a multiplexer configured to receive and multiplex said at least two subsets of output image data from the second and third LUTs to produce driving image data;

a driver configured to receive said driving image data from the multiplexer; and a fourth LUT and a fifth LUT configured to receive the driving image data from the driver, the fourth and fifth LUTs adjusting the driving image data for display on the display panel according to electro-optical properties of said display panel.

7. The display system of claim 6 wherein said demultiplexer selects at least two subsets of output image data according to a color of the subpixels on said display panel where said output image data is to be displayed.

8. The display system of claim 7 wherein said at least two subsets of output image data indicate image data of same-colored subpixels on said display panel where said output image data is to be displayed.

9. The display system of claim 6 wherein each of said second and third LUTs adjusts a respective one of said subsets of output image data by a quantity inverse to an adjustment made by said fourth and fifth LUTs to the driving image data for display on the display panel according to electro-optical properties of said display panel.

10. The display system of claim 9 wherein said fourth and fifth LUTs adjust the driving image data for display on the display panel according to a gamma transfer function of said display panel, and each of said second and third LUTs adjusts a respective one of said subsets of output image data by a quantity inverse to said gamma transfer function of said display panel.

11. The display system of claim 6 wherein each of said second and third LUTs adjusts a respective one of said subsets of output image data by a quantity that changes a brightness level of said respective output image data.

12. The display system of claim 6 wherein each of said second and third LUTs adjusts a respective one of said subsets of output image data by a quantity that changes color values of said respective output image data.

13. A display system comprising:

a display panel having a plurality of subpixels arranged in rows and columns;

driver circuitry providing image data signals and polarity signals to said subpixels; said driver circuitry comprising at least two driver chips; said subpixels disposed in columns at the boundary of said at least two driver chips receiving identical polarity signals; and at least one look-up table (LUT) storing corrective data signals that correct for fixed pattern noise caused by said subpixels being driven by said identical polarity signals; said driver circuitry adjusting said image data signals of said subpixels disposed in columns at the boundary of said at least two driver chips using said corrective data signals.

* * * * *